United States Patent [19]

Kajimura et al.

[11] 4,382,213

[45] May 3, 1983

[54] IMAGE PICKUP APPARATUS

[75] Inventors: Motoji Kajimura; Hiroyuki Echigo; Yoshiaki Hashizume, all of Yokohama, Japan

[73] Assignee: Tokyo Shibaura Denki Kabushiki Kaisha, Kawasaki, Japan

[21] Appl. No.: 237,725

[22] Filed: Feb. 24, 1981

Related U.S. Application Data

[63] Continuation of Ser. No. 924,901, Jul. 13, 1978, abandoned.

[30] Foreign Application Priority Data

Aug. 26, 1977 [JP] Japan ..... 52/101702
Sep. 13, 1977 [JP] Japan ..... 52/109464

[51] Int. Cl.[3] ..... H01J 29/66; H01J 31/26
[52] U.S. Cl. ..... 315/382; 313/389
[58] Field of Search ..... 315/382; 313/389

[56] References Cited

U.S. PATENT DOCUMENTS 2,901,661 8/1959 Neuhauser ..... 315/382 X
3,319,110 5/1967 Schlesinger ..... 315/382 X
3,691,423 9/1972 Yoshikawa et al. ..... 315/31 TV
3,961,219 6/1976 Bechteler ..... 313/389
4,044,282 8/1977 Balandin et al. ..... 315/382

*Primary Examiner*—Malcolm F. Hubler
*Attorney, Agent, or Firm*—Cushman, Darby & Cushman

[57] ABSTRACT

An image pickup apparatus designed to improve the amplitude modulation degree particularly at edge portions of an image comprises an image pickup tube and a yoke assembly. The image pickup tube includes a target, a focusing electrode and an electron beam limiting aperture for limiting the diameter of an electron beam. The yoke assembly comprises means for generating a focusing magnetic field and means for generating a deflection magnetic field. The distance between the electron beam limiting aperture and the target is at least 5.5 times the maximum diameter of the focusing electrode. The half width of the focusing magnetic field intensity distribution along the axis of the image pickup tube is at least 85% of the distance between the electron beam limiting aperture and the target. The focusing magnetic field intensity in the middle portion of the distribution having at least the half value of the focusing magnetic field intensity distribution is smaller than the focusing magnetic field intensity near the target.

12 Claims, 15 Drawing Figures

| DEFLECTION MAGNETIC FIELD $Z_1-Z_2$ | | SHAPE OF ELECTRON BEAM SPOT ON TARGET SURFACE | DEFLECTION MAGNETIC FIELD $Z_1-Z_2$ | | SHAPE OF ELECTRON BEAM SPOT ON TARGET SURFACE |
|---|---|---|---|---|---|
| $Z_1$ | $Z_2$ | | $Z_1$ | $Z_2$ | |
| 0 | $2\pi$ |  | $\frac{1}{6}\pi$ | $2\pi$ |  |
| 0 | $\frac{11}{6}\pi$ |  | $\frac{1}{3}\pi$ | $2\pi$ |  |
| 0 | $\frac{5}{3}\pi$ |  | $\frac{1}{2}\pi$ | $2\pi$ |  |
| 0 | $\frac{3}{2}\pi$ |  | $\frac{1}{2}\pi$ | $\frac{3}{2}\pi$ |  |

IMAGE PICKUP APPARATUS

This is a continuation of application Ser. No. 924,901, filed July 13, 1978, now abandoned.

This invention relates to an image pickup apparatus which improves the amplitude modulation degree particularly at edge portions of picture image.

FIG. 1B shows an image pickup apparatus comprising a known vidicon pickup tube which is a low velocity scanning type image pickup tube and a known yoke assembly which generates magnetic fields for focusing and deflecting an electron beam. In such an image pickup apparatus, electric field intensity and magnetic field intensity distribute as illustrated in FIG. 1A.

The image pickup apparatus 1 shown in FIG. 1B comprises an image pickup tube 2, a focusing coil 3, a deflecting coil 4 and an alignment coil 5. Within the image pickup tube 2 and along the axis thereof there are serially arranged a heater 6, a cathode 7, a beam control electrode 8, an accelerating electrode 9, an electron beam limiting aperture 10, a focusing electrode 11, a mesh electrode 12 and a target 13.

The cathode 7 is heated by the heater 6 to generate a thermoelectron flow. The thermoelectron flow is controlled by the beam control electrode 8 applied with a negative potential and is then accelerated by the accelerating electrode 9. The electron beam has both its diameter and its velocity components limited by the electron beam limiting aperture 10 and is guided to the focusing and deflecting region of the apparatus. In the focusing and deflecting region the electron beam is focused by a magnetic field generated by the focusing coil 3 provided outside the image pickup tube 2 and deflected by a magnetic field generated by the deflecting coil 4 provided also outside the image pickup tube 2. Then the electron beam is so bent to run parallel to the axis of the tube 2 by means of a collimation lens formed of an electric field near the mesh electrode 12. Thus, it runs perpendicular to the target 13 for proper scanning.

To focus and deflect an electron beam effectively it is necessary to reduce the aberration of electron beam focusing, to minimize the geometrical distortion of figure resulting from electron beam deflection, to make the angle of incidence of electron beam 90° to any surface portion of the target and to reduce the focusing error at edge portions of a picture image resulting from electron beam deflection. In the image pickup apparatus shown in FIG. 1B the movement of an electron beam are determined by an electromagnetic field, i.e. combination of an electrostatic field generated in the image pickup tube 2 and a magnetic fields generated by the yoke assembly constituted by the focusing coil 3 and the deflecting coil 4. More specifically, an electron beam deflected by the deflection magnetic field is further bent by a collimation lens defined by the potential distribution between the focusing electrode 11 and the mesh electrode 12, so that its angle of incidence to the target 13 may be 90°.

Along the axis of the image pickup apparatus shown in FIG. 1B there are observed such typical focusing magnetic field distribution Fa, typical deflecting magnetic field distribution Da and typical potential distribution Va as illustrated in FIG. 1A. The alignment coil 5 generates a magnetic field which acts on the electron beam in the accelerating electrode 9 and which adjusts both vertical and horizontal velocity components of the electron beam so that it runs from the electron beam limiting aperture 10 correctly along the axis of the electrode group. The magnetic field created by the alignment coil 5 distributes as shown by line Aa in FIG. 1A. The alignment coil 5 may be replaced by a permanent magnet.

As curve Va in FIG. 1A shows, the potential distributes substantially uniformly between the accelerating electrode 9 and the collimation lens formed between the focusing electrode 11 and the mesh electrode 12. But from the collimation lens to the target 13 the potential drops sharply to a low target surface potential which is nearly equal to the potential of the cathode 7. In other words, the potential distribution between the collimation lens and the target 13 makes a high retardation electric field. The image pickup tube 2 is therefore called "low velocity scanning type image pickup tube". The focusing magnetic field generated by the focusing coil 3 distributes as indicated by cloche-shaped curve Fa in FIG. 1A, and in this sense it is similar to a magnetic field which is generated by a solenoid coil and which extends in the axial direction of an image pickup tube. The deflection magnetic field generated by the deflection coil 4 consists of a vertical deflection magnetic field and a horizontal deflection magnetic field, and its intensity distributes as indicated by cloche-shaped curve Da in FIG. 1A showing only one direction. The deflection magnetic field is thus similar to the focusing magnetic field in respect of its intensity distribution.

The known image pickup apparatus of such type as mentioned above is disadvantageous in that the amplitude modulation degree is low at edge portions of a picture image though its resolution, i.e. amplitude modulation degree, is high at the central portion of the picture image in comparison with an electric field focusing system. Consequently, the amplitude modulation degree of the entire picture image does not become uniform. This drawback is chiefly due to the fact that electron beam spots on the edge portions are larger than those on the central portion of the target and are deformed unlike those on the central portion. Such unwanted defocusing of electron beam on the edge portions of the target can be reduced to some extent if the deflecting magnetic field is generated at the remotest posible position from the target, thus minimizing the deflection angle and the distance between the focusing surface of the beam and the edge portions of the target. To generate a deflecting field at a position as remote as possible from the target, however, is to enhance the distortion of electron beam in the focusing region. Further, if a deflection field is generated far from the target 13, the magnification of a focusing lens must be increased, thus increasing both beam astigmatism and the size of beam spots at the edge portions of the picture image, and lowering the amplitude modulation degree at the edge portions of the picture image. In short, to position a deflection magnetic coil far from the target is to impede the improvement of amplitude modulation degree at the edge portions of a picture image. In practice the distance between the target and the deflection magnetic coil is limited.

In the image pickup apparatus shown in FIG. 1B, the beam spots on the edge portions of the target 13 seem distorted to become such elongated ones as illustrated in FIG. 2. This is because the electron beam tends to be distorted depending on the direction of the deflection scanning.

When the image pickup apparatus picks up monochromatic slant line burst slanting in one direction, two horizontal scanning outputs corresponding to the upper and lower edge portions of a picture image, respectively have such waveforms as illustrated in FIG. 3. If the monochromatic line burst slants in the direction mutually symmetrical with said direction, the waveforms of the horizontal scanning outputs become as if turned by 180°.

The distortion of electron beam spots at the edge portions of the picture image will now be described more in detail with reference to FIGS. 4 and 5.

As shown in FIG. 4, a thermoelectron flow generated by the cathode 7 is controlled in amount by the beam control electrode 8 applied with a negative potential. The electron beam is then focused by a convex lens formed of the beam control electrode 8 and the accelerating electrode 9, thereby forming a cross-over point. Thereafter the beam has its diameter and its velocity components in radial directions limited by the electron beam limiting aperture and is then guided to the focusing electrode 11. In the focusing region the electron beam tends to diverge since it still contains velocity components in radial directions, but it is focused by a focusing magnetic field generated by the focusing coil 3. As a result, the electron beam forms one loop between the cross-over point Zo and the surface of the target 13.

Let it be assumed that the focusing coil 3 generates a focusing magnetic field which is uniform in intensity and that the deflecting coil 4 generates such a deflection magnetic field as would deflect the electron beam in X direction at the cross-over point Zo over range $Z_1$ to $Z_2$ as shown in FIG. 4. The shape of an electron beam spot formed on the surface ($2\pi$) of the target 13 under this condition, which is determined by an electromagnetic focusing loop, can be obtained by computation. Various shapes of an electron beam spot thus obtained are shown in FIG. 5. FIG. 5 teaches that the beam spot will be distorted in various ways when the deflection magnetic field region ($Z_1$–$Z_2$) is shorter than the distance 0–$2\pi$ between the cross-over point Zo and the surface of the target 13. As the deflection magnetic field region $Z_1$–$Z_2$ moves along the axis of the image pickup apparatus, both the orientation of the beam spot and the ratio between the major and minor axes of the beam spot change. As FIG. 5 shows, the farther the point $Z_2$ is located from the surface of the target 13, the more the beam spot is elongated. Thus, if an image of slant line bursts is picked up by an image pickup apparatus wherein point $Z_2$ is very far from the surface of a target, the same amplitude modulation cannot be gained at the edge portions of the image. Such image pickup apparatus is therefore not useful practically.

An object of this invention is to provide an image pickup apparatus in which an amplitude modulation degree is uniform over an entire picture image and particularly the amplitude modulation at edge portions of a picture image is improved.

Another object of this invention is to provide a yoke assembly which is to be used in the image pick up apparatus according to this invention, which is light and consumes less power and in which an end portion of a focusing coil is never over-heated.

According to this invention there is provided an image pickup apparatus which comprises an image pickup tube including a focusing electrode, a target and an electron beam limiting aperture for limiting the diameter of an electron beam and a yoke assembly including means for generating a focusing magnetic field and means for generating a deflection magnetic field. In the image pickup apparatus, the distance between the electron beam limiting aperture and the target is at least 5.5 times maximum diameter of the focusing electrode, the half width of the focusing magnetic field intensity distibution along the axis of the image pickup tube is at least 85% of the distance between the electron beam limiting aperture and the target, and the focusing magnetic field intensity in the middle portion of the distribution having at least the half value of the focusing magnetic field intensity distribution is smaller than the focusing magnetic field intensity near the target.

Further, according to this invention there is provided a yoke assembly for the above-mentioned image pickup apparatus, which is provided with two disk-shaped pole pieces at its ends, respectively.

This invention can be more fully understood from the following detailed description when taken in conjunction with the accompanying drawings, in which.

Figure 1A:
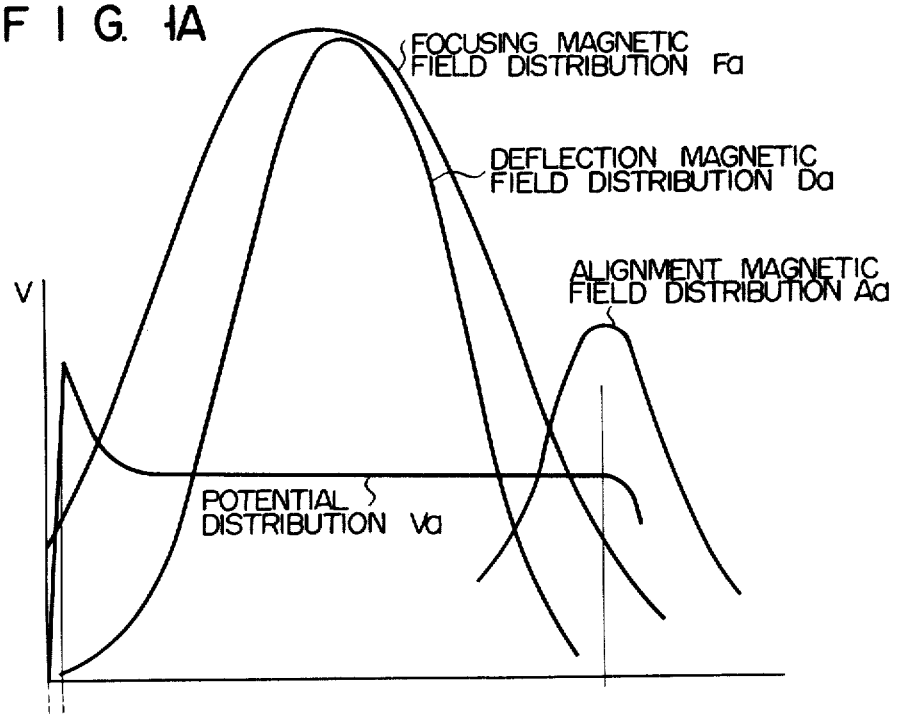
FIG. 1A is a graph showing magnetic field intensity distribution and electric field intensity distribution in a conventional image pickup apparatus.
Figure 1B:
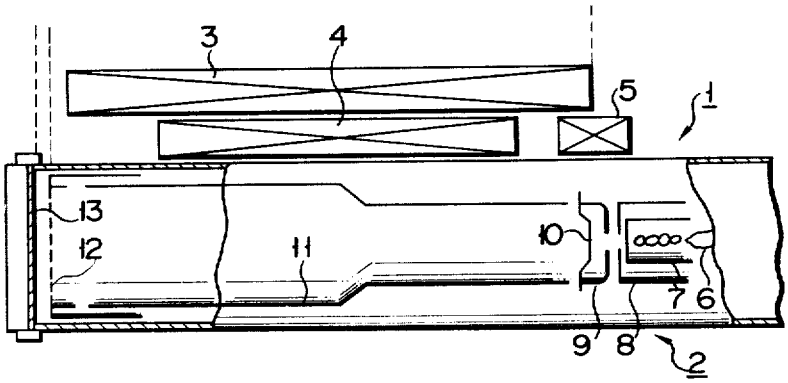
FIG. 1B is a schematical cross sectional view of the conventional image pickup apparatus in which there are observed such magnetic field intensity distribution and such electric field intensity distribution as illustrated in FIG. 1A.
Figure 2:
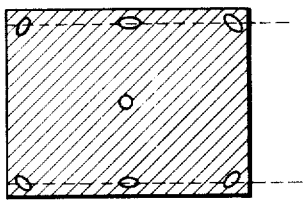
FIG. 2 shows various shapes of an electron beam spot on the surface of a target.
Figure 3:
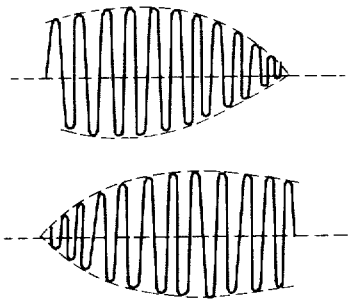
FIG. 3 shows waveforms of two horizontal scanning outputs which correspond to the upper and lower edge portions of the target surface shown in FIG. 2, respectively.
Figure 4:
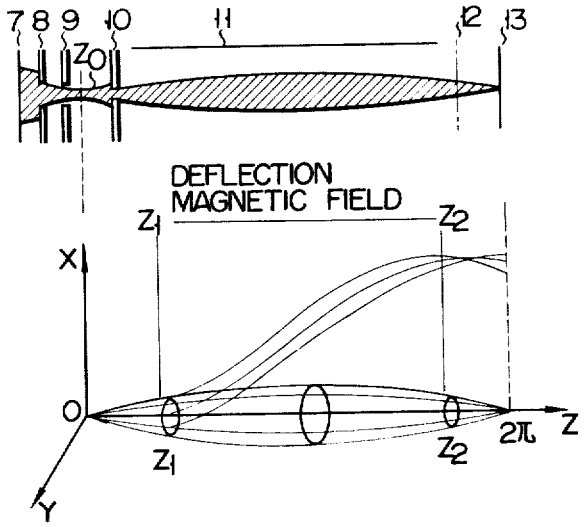
Figure 5:
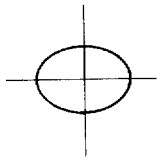
Figure 5:
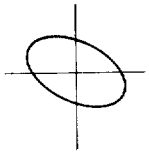
Figure 5:
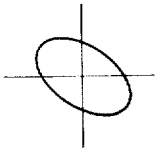
Figure 5:
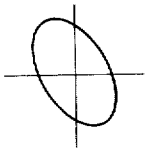
Figure 5:
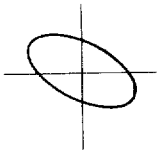
Figure 5:
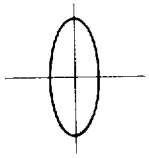
Figure 5:
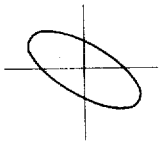
Figure 5:
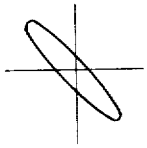
Figure 6A:
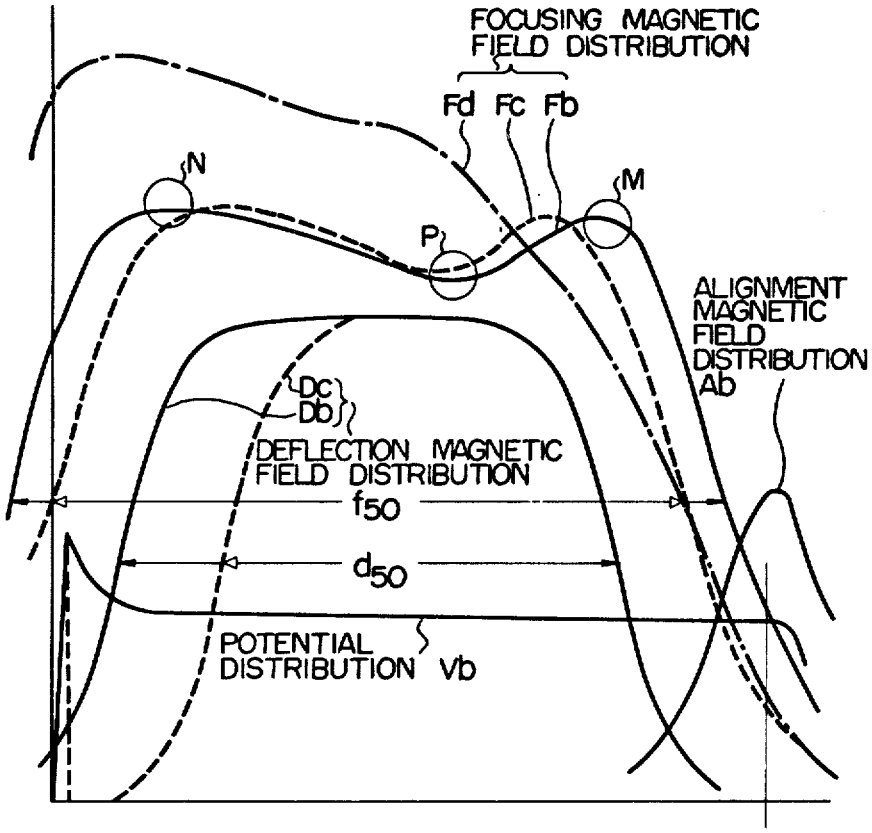
Figure 6B:
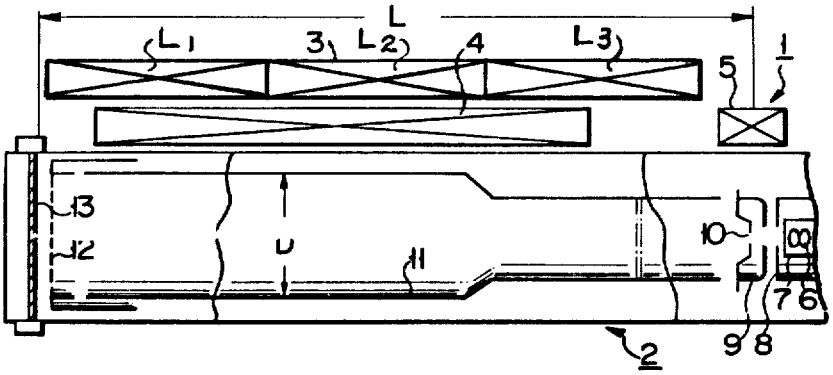
Figure 7A:
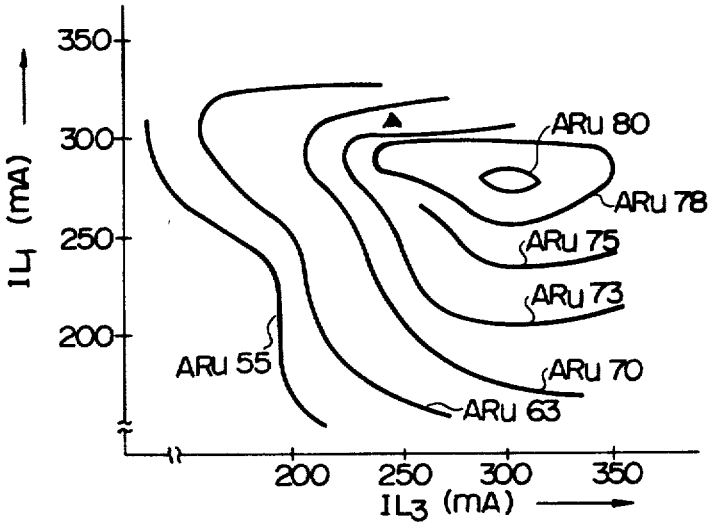
Figure 7B:
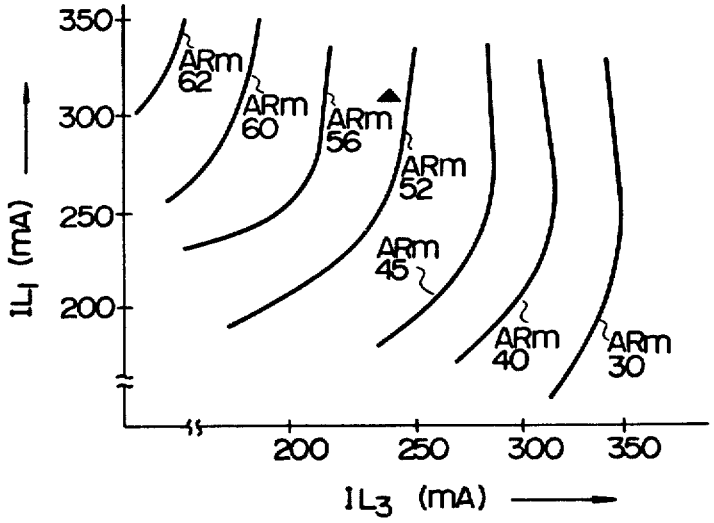
Figure 8:
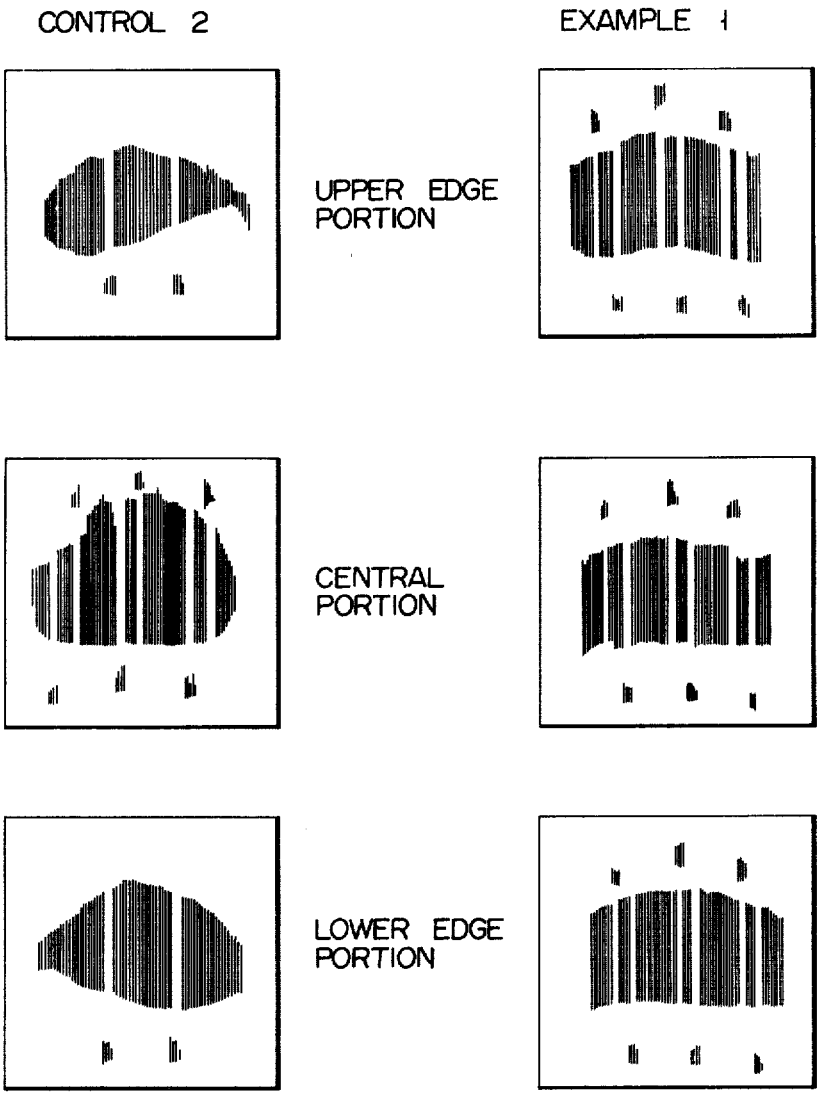
Figure 9:
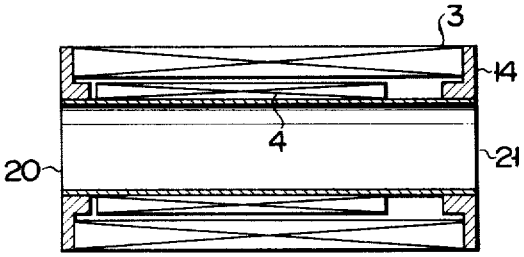
Figure 10:
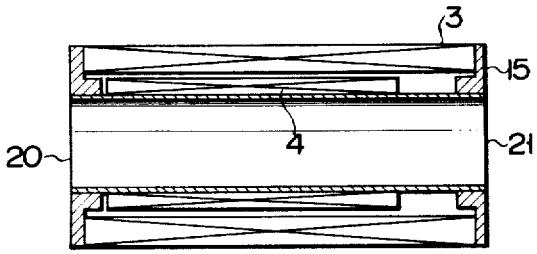
Figure 11:
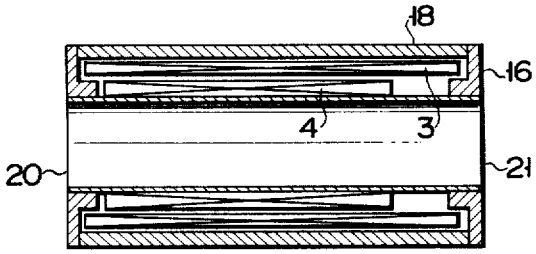
Figure 12:
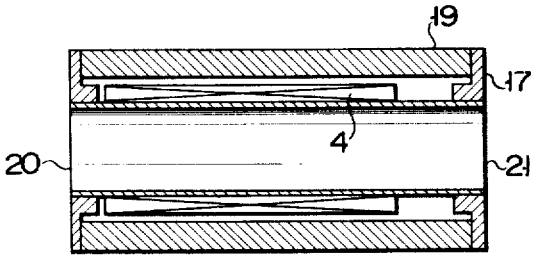

FIG. 4 explains how an electron beam is distorted;

FIG. 5 shows various shapes which an electron beam spot may have when the deflection magnetic field region is expanded or narrowed;

FIG. 6A is a graph showing magnetic field intensity distribution and electric field intensity distribution in an image pickup apparatus according to this invention;

FIG. 6B is a schematic cross sectional view of the image pickup apparatus in which there are observed such magnetic field intensity distribution and such electric field intensity distribution as illustrated in FIG. 6A;

FIG. 7A is a graph wherein curves show the ratios ARu of the lowest amplitude modulation degree at the edge portions of a picture image of the amplitude modulation degree at the central portion of the picture image, the ratios ARu being determined by a relative change between focusing currents $I_{L1}$ and $I_{L3}$;

FIG. 7B is a graph wherein curves show amplitude modulation degrees ARm at the central portion of a picture image which are determined by a relative change between focusing currents $I_{L1}$ and $I_{L3}$;

FIG. 8 shows the waveforms of output signals obtained by a conventional image pickup apparatus and by an embodiment of this invention when a picture image is scanned along three horizontal scanning lines across the upper, middle and lower portions of the picture image, respectively;

FIG. 9 is a cross sectional view of a yoke assembly according to this invention; and FIGS. 10 to 12 are cross sectional views of other yoke assemblies according to this invention.

With reference to the accompanying drawings one preferred embodiment of this invention will be described.

As shown in FIG. 6B, an image pickup apparatus 1 according to this invention comprises an image pickup tube 2 and a yoke assembly. The yoke assembly includes a focusing coil 3, a deflecting coil 4 and an alignment coil 5 which are provided outside the image pickup tube 2. Within the tube 2 and along the axis thereof there are serially arranged a heater 6, a cathode 7, a beam control electrode 8, an accelerating electrode 9, an electron beam limiting aperture 10, a focusing electrode 11, a mesh electrode 12 and a target 13.

The electron beam limiting aperture 10 and the target 13 are so positioned that the distance L between them is 6.5 times maximum diameter D of the focusing electrode 11. Thus, $L/D=6.5$.

Right after it has been emitted from the electron beam limiting aperture 10, an electron beam comes into a focusing magnetic field, the intensity of which is 28% of the maximum magnetic field intensity which can be generated by the focusing coil 3. While having its divergence angle limited by the focusing magnetic field, the electron beam is guided to a first maximum magnetic field intensity region M of a focusing magnetic field intensity distribution Fb shown in FIG. 6A. Thereafter the electron beam is deflected by a deflection magnetic field generated by the deflecting coil 4 and having an intensity distibution Db. The point where the deflection magnetic field acts on the electron beam is positioned as close as possible to the accelerating electrode 9.

Owing to a cooperative effect of the above-mentioned specific positional relationship between the electron beam limiting aperture 10 and the target 13, and the focusing and deflection magnetic fields, the distortion of beam spots on the edge portions of the target 13 is reduced, thus rendering uniform the amplitude modulation degree over the entire picture image.

Moreover, the focusing magnetic field intensity distribution Fb includes a low intensity region P which extends from the first maximum intensity region M toward the target 13, and the deflection magnetic field intensity distribution Db has a uniform intensity region which extends from near the low intensity region P toward the target 13. Such focusing and deflection magnetic fields cooperate to moderate the distortion of beam spots. Namely, the electron beam is rotated by the focusing magnetic field and then distorted by the deflection magnetic field, but to a limited degree owing to the cooperation of the focusing and deflection magnetic fields. Further, the focusing magnetic field intensity distribution Fb has a second maximum intensity region N which lies between the low intensity region P and the target 13, rather close to the target 13. The second maximum intensity region N suppresses an increase of beam distortion in the deflection magnetic field near the target 13. In addition, the region N reduces the aberration of the beam in a collimation lens region between the focusing electrode 11 and the mesh electrode 12. Thus the region N serves to limit the diameter of the electron beam spots on the target 13, thereby reducing the magnification of a focusing lens. This effectively improves the amplitude modulation degree at the edge portions of the picture image and thus makes uniform the amplitude modulation degree of the entire picture image.

The focusing magnetic field region having half the maximum intensity, i.e. half width $f_{50}$ of the focusing magnetic field intensity distribution Fb, is 97% of the distance L between the electron beam limiting aperture 10 and the target 13. This is another feature of the image pickup apparatus shown in FIG. 6B. The part of the focusing magnetic field in the vicinity of the target 13 functions as a divergent magnetic field to position a focusing point of the electron beam directed to the edge portions of the target 13 as close to the edge portions.

The focusing electrode 11 and the mesh electrode 12 constitute a collimation lens. The collimation lens has a small magnification, just enough to for the small deflection angle of the electron beam.

The deflection magnetic field intensity distribution Db includes an attenuation region, which is positioned as closely as possible to the target 13. The deflection magnetic field may be lengthen so much along the axis of the apparatus that a magnetic field having 10% of the maximum intensity exists near the target 13. If this is the case, the beam distortion caused in the part of the deflection magnetic field in the vicinity of the target 13 can be reduced all the way until the electron beam lands on the target 13. In this case the half value width $d_{50}$ of the deflection magnetic field intensity distribution Db is 67% of the distance L between the electron beam limiting aperture 10 and the target 13, thus $d_{50}/L=0.67$.

In the image pickup apparatus shown in FIG. 6B, the image pickup tube 2 has such a size and the focusing and deflection magnetic fields have such distributions that $L/D=6.5$, $f_{50}/L=0.97$ and $d_{50}/L=0.67$. But L/D, $f_{50}/L$ and $d_{50}/L$ need not be limited to these particular values. The apparatus according to this invention operates effectively if L/D is 5.5 or more, $f_{50}/L$ is 0.85 or more and $d_{50}/L$ is 0.55 or more. $d_{50}/L$ need not be 0.55 or more so long as L/D is 5.5 or more and $f_{50}/L$ is 0.85 or more.

If L/D, $f_{50}/L$ and $d_{50}/L$ are 5.5, 0.85 and 0.55, respectively, the focusing magnetic field and deflection magnetic field will show such intensity distributions as illustrated in FIG. 6A in dotted lines Fc and Dc, respectively. Also in this embodiment, the amplitude modulation degree at the edge portions of the picture image is improved, and the amplitude modulation degree of the entire picture image becomes uniform.

In both embodiments such focusing and deflection magnetic field intensity distributions as shown in FIG. 6A are obtained if, for example, the mesh electrode 12, focusing electrode 11, accelerating electrode 9 and cathode 7 are applied with 750 V, 680 V, 300 V, and 0 V, respectively. To control the electron beam focusing on the target surface, the intensity of the focusing magnetic field is varied while preserving the intensity distribution Fb, or the focusing electrode voltage is varied in the vicinity of 680 V while setting the intensity of the focusing magnetic field at a specific value.

In order to reshape the focusing magnetic field intensity distribution in the image pickup apparatus according to this invention, different focusing currents $I_{L1}$, $I_{L2}$ and $I_{L3}$ were applied to three sections $L_1$, $L_2$ and $L_3$ of the focusing coil 3, respectively, the sections $L_1$, $L_2$ and $L_3$ being arranged in this order toward the acceleration electrode 9. As the focusing currents $I_{L1}$ and $I_{L3}$ were varied, various amplitude modulation degrees ARm at the central portion of the picture image were obtained as illustrated in FIG. 7B. Namely, each amplitude modulation degree ARm was determined by the focusing currents $I_{L1}$ and $I_{L3}$. Similarly, as the focusing currents $I_{L1}$ and $I_{L3}$ were varied, various amplitude modulation degrees at the edge portions of the picture image were obtained. The ratio of the lowest amplitude modulation at the edge portions to the amplitude modulation degree ARm was calculated to indicate the uniformity of the amplitude modulation degree of the entire picture image. The obtained ratios ARu were plotted with respect to the focusing currents $I_{L1}$ and $I_{L3}$ as illustrated in FIG. 7A.

Both $I_{L1}$ and $I_{L3}$ were measured while, the focusing current $I_{L2}$ was adjusted so as to maintain such a focusing magnetic field intensity distribution as shown in FIG. 6A under the condition of proper voltages applied to the cathode 7 and the electrodes 9, 11 and 12. As FIG. 7B shows, ARm increased in proportion to the intensity of the magnetic field near the target 13, which corresponds to $I_{L1}$. FIG. 7A shows that ARu increased in proportion to both the intensity of the magnetic field near the accelerating electrode 9 which corresponds to $I_{L3}$ and the intensity of the magnetic field near the target 13 which corresponds to $I_{L1}$. As a result, the intensity of the magnetic field generated by the section $L_2$ of the focusing coil 3 was lowered a little.

▲-marks in FIGS. 7A and 7B show the values of ARm and ARu which corresponding to the focusing magnetic field intensity distribution Fb shown in FIG. 6A. These marks indicate that in the apparatus shown in FIG. 6B the uniformity of amplitude modulation degree of the entire screen (i.e. ARu) is elevated nearly to the maximum value and that the amplitude modulation degree ARm at the central portion of the screen is elevated too. Of course, ARm may be elevated to the maximum value while ARu is elevated to the resultant focusing magnetic field intensity distribution would fail to reduce the electron beam distortion to a sufficient extent.

The focusing magnetic field may have such an intensity distribution Fd indicated by a chain line in FIG. 6A. This invention aims to deflect an electron beam from the electron beam limiting aperture 10 in an effective focusing magnetic field without increasing the distortion of the electron beam. To achieve this object, it is not always necessary to generate a focusing magnetic field the intensity distribution of which has two maximum values or peaks. If the focusing magnetic field has such intensity distribution Fd as shown in FIG. 6A, the focusing electrode 11 may be divided into two sections Y as indicated by the chain line in FIG. 6B, and the section near the electron beam limiting aperture 10 may be applied with a specific potential thereby to form an electric field lens. Such an electric field lens can focus the electron beam without increasing the beam distortion. Thus, if such an electric field lens is used, both the focusing magnetic field intensity and the deflection magnetic field intensity will be lowered, whereby the power consumption is reduced.

The conventional image pickup apparatus each comprising a known image pickup tube and a known yoke assembly have such features as given in the following Table 1. The features of the first embodiment of this invention, which provides focusing magnetic field intensity distribution Fb and deflection magnetic field intensity distribution Db, are also set forth in Table 1 for comparison.

TABLE 1

| | Image pickup tube | Yoke assembly | Focusing magnetic field pattern | L/D | $f_{50}$/L(%) | $d_{50}$/L(%) |
|---|---|---|---|---|---|---|
| Control 1 | 8541 | KV-8 | | 4.9 | 69 | 43 |
| Control 2 | E5240 | YS-7132 | | 4.9 | 79 | 55 |
| Control 3 | 8816 | KV-14B | | 6.5 | 70 | 32 |
| Control 4 | E5040 | EPC-003A | | 6.0 | 79 | 66 |

TABLE 1-continued

| | Image pickup tube | Yoke assembly | Focusing magnetic field pattern | L/D | $f_{50}$/L(%) | $d_{50}$/L(%) |
|---|---|---|---|---|---|---|
| Control 5 | 8844 | KV-12 | | 5.0 | 87 | 44 |
| Embodiment 1 | — | — | | 6.5 | 97 | 67 |

As Table 1 shows, the embodiment 1 of this invention has the largest L/D, $f_{50}$/L and $d_{50}$/L. Table 1 further shows that in none of the controls L/D and $f_{50}$/L are 5.5 or more and 85% or more, respectively.

A conventional image pickup apparatus is known, in which L/D, $f_{50}$/L and $d_{50}$/L are 4.9, 1.21 and 1.01, respectively. This image pickup apparatus (or control 4), controls 1, 2 and 3 and the embodiment 1 of this invention, and the second embodiment of this invention which provides focusing magnetic field intensity distribution Fd were operated to measure ARu and ARm. The results are shown in the following Table 2.

TABLE 2

| | L/D | $f_{50}$/L (%) | $d_{50}$/L (%) | Focusing magnetic field pattern | Aru | Arm |
|---|---|---|---|---|---|---|
| Control 1 | 4.9 | 69 | 43 | cloche | 35 | 55 |
| Control 2 | 4.9 | 79 | 55 | cloche | 40 | 55 |
| Control 3 | 6.5 | 70 | 32 | cloche | 50 | 40 |
| Control 4 | 4.9 | 121 | 101 | mesa | 60 | 30 |
| Embodiment 1 | 6.5 | 97 | 67 | (see FIG. 6A) | 70 | 52 |
| Embodiment 2 | 6.5 | 89 | 67 | (see FIG. 6A) | 70 | 60 |

As Table 2 shows, ARu and ARm have sufficient values when L/D is 5.5 or more and $f_{50}$/L is 85% or more, and particularly when L/D is 5.5 or more, $f_{50}$/L is 85% or more and $d_{50}$/L is 55% or more.

FIG. 8 shows the waveforms of output signals which were obtained by the apparatus of control 2 and the apparatus of example 1 when three scanning lines were selected from the upper, middle and lower portions of the image, respectively. Comparison of the waveforms of the signals obtained by these apparatus will clearly show the difference between these apparatus in the uniformity of amplitude modulation degree.

The focusing coil 3 used in the above-mentioned image pickup apparatus is constituted by three sections $L_1$, $L_2$ and $L_3$, thereby to generate a focusing magnetic field having a desired intensity distribution. The three sections may have different numbers of turns so as to adjust the intensity distribution of the resultant focusing magnetic field. This method of adjusting the magnetic field intensity distribution is disadvantageous, however. That is, the focusing coil 3 utilizes the current less effectively than a known focusing coil. Thus, to generate a magnetic field of a specific intensity distribution, it needs to consume more electric power than the known focusing coil. This problem can be solved if pole pieces or permanent magnets are added to the yoke assembly as illustrated in FIGS. 9 to 12.

The yoke assembly shown in FIG. 9 comprises a focusing coil 3, a deflection coil 4, an alignment coil 5 (not shown) and a pair of disk-shaped pole pieces 14. An image pickup tube (not shown) is to be inserted in the yoke assembly and held therein so that a target is positioned at one end 20 and a stem pin is positioned at the other end 21. The pole pieces 14 are attached to the ends 20 and 21 of the yoke assembly, respectively and are made of pure iron or mild steel. Thus, a focusing magnetic field of a specific intensity is induced about the pole pieces 14 by the magnetism generated by the focusing coil 3.

The yoke assembly shown in FIG. 10 is identical in construction with the yoke assembly of FIG. 9, except that a pair of disk-shaped permanent magnets 15 are used as pole pieces. Each permanent magnet 15 is magnetized in radial direction so as to intensify the focusing magnetic field generated by the focusing coil 3.

The yoke assembly shown in FIG. 11 is identical in construction with the yoke assembly of FIG. 9, except that a pair of permanent magnet rods 18 are provided outside the focusing coil 3. It is desired that the permanent magnetic rods 18 be made of alnico or the like, since ferrite adversely has a magnetic power with a relatively large temperature coefficient of about 4% at a temperature change of 10° C. Two or more perment magnet rods 18 may better be arranged about the focusing coil 3 at regular intervals in the circumferential direction of the coil 3, so as to impart magnetism of the same intensity to the pole pieces 16 and thus to generate a focusing magnetic field having such a desired intensity distribution as illustrated in FIG. 6A. Only if a proper current is applied to the focusing coil 3, the yoke assembly can generate a focusing magnetic field having a desired intensity distribution. Further, the yoke assembly focuses an electron beam in an optimum way, without adjusting the focusing electrode voltage in the image pickup tube 2. In view of this the yoke assembly shown in FIG. 11 is practically useful.

The yoke assembly shown in FIG. 12 comprises a deflection coil 4, an alignment coil 5 (not shown), a pair of pole pieces 17 and a pair of permanent magnet rods 19. The pole pieces 17 are shaped like a disk, made of pure iron or mild steel, and attached to the ends of the yoke assembly, respectively. The permanent magnet rods 19 function as a focusing coil. Not provided with a focusing coil, the yoke assembly is lighter and generates less heat than those of FIGS. 9 to 11. The yoke assembly shown in FIG. 12, though made simple, is practically useful, too.

As mentioned above, the image pickup apparatus according to this invention can reduce distortion of an electron beam. Since the distortion of electron beam is limited, the amplitude modulation degree will not be lowered so much or the uniformity of amplitude modulation degree will not be so critically reduced as in the conventional image pickup apparatus, even if the electron beam is focused by a focusing electrode voltage of not optimum value or by a focusing magnetic field of not optimum intensity. For example, the level of modulation signals obtained by scanning stripes slanting at an angle scarcely differs from the level of modulation signals obtained from stripes slanting at a different angle. Such a difference in level of modulation signals should be avoided since it would critically harmful to a color image pickup camera using a single tube type image pickup tube which is generally used in a frequency separation system. Moreover, in the image pickup apparatus according to this invention the difference between the focusing voltages applied on the central portion and edge portions of the target is reduced to 0 to 2 V, whereas the voltage difference is 6 to 8 V in the conventional image pickup apparatus. This small voltage difference facilitates the adjustment of various operation characteristics of the apparatus and helps enhance the operation stability of the apparatus.

What we claim is:

1. An image pickup apparatus comprising:

an image pickup tube including a focusing electrode, a target and an electron beam limiting aperture for limiting the diameter of an electron beam, the distance between said target and said electron beam limiting aperture being at least 5.5 times the maximum diameter of said focusing electrode; and a yoke assembly means surrounding said pickup tube including means for generating a deflection magnetic field and means for generating a focusing magnetic field, the half value width of the intensity distribution of said focusing field along the axis of said image pickup tube being at least 85 percent of the distance between said target and said electron beam limiting aperture, and the intensity of said focusing field in an intermediate position between said target and said electron beam limiting aperture being smaller than the focusing magnetic field intensity both near the target and near said electron beam limiting aperture to form two intensity peaks.

2. An image pickup apparatus according to claim 1, wherein the half width of the deflection magnetic field intensity distribution along the axis of said image pickup tube is at least 55 percent of the distance between said target and said electron beam limiting aperture.

3. An image pickup apparatus according to claim 1, wherein said yoke assembly further comprises a pair of disk-shaped pole pieces attached to its ends, respectively.

4. An image pickup apparatus according to claim 3, wherein said pole pieces are made of a metal selected from the group consisting of pure iron and mild steel.

5. An image pickup apparatus according to claim 3, wherein said pole piece are permanent magnets.

6. An image pickup apparatus according to claim 3, wherein said yoke assembly further comprises a plurality of permanent magnet rods arranged parallel to its axis.

7. An image pickup apparatus according to claim 3, wherein said means for generating a focusing magnetic field is constituted by a plurality of permanent magnet rods arranged parallel to the axis of said yoke assembly and a focusing coil.

8. A yoke assembly for use in combination with the image pickup apparatus according to claim 1, comprising means for generating a focusing magnetic field, means for generating a deflection magnetic field, and a pair of disk-shaped pole pieces attached its ends, respectively.

9. A yoke assembly according to claim 8, wherein said pole pieces are permanent magnets.

10. A yoke assembly according to claim 8, wherein said pole pieces are made of a metal selected from the group consisting of pure iron and mild steel.

11. A yoke assembly according to claim 10, further comprising a plurality of permanent magnet rods arranged parallel to its axis.

12. A yoke assembly according to claim 10, wherein said means for generating a focusing magnetic field is constituted by a plurality of permanent magnet rods arranged parallel to the axis of the yoke assembly and a focusing coil.

* * * * *